US005773800A

United States Patent [19]

Choy

[11] Patent Number: 5,773,800

[45] Date of Patent: Jun. 30, 1998

[54] APPARATUS AND METHOD FOR PERCEIVING OR ABSENCE OF A COVER FOR A CONTAINER AND FOR DETERMINING A QUALITY OF FOOD IN THE CONTAINER IN A MICROWAVE OVEN

[75] Inventor: Lee-jon Choy, Pusan, Rep. of Korea

[73] Assignee: LG Electronics Inc., Seoul, Rep. of Korea

[21] Appl. No.: 764,124

[22] Filed: Dec. 12, 1996

[30] Foreign Application Priority Data

Mar. 26, 1996 [KR] Rep. of Korea ..... 1996-8414

[51] Int. Cl.[6] ..... H05B 6/68

[52] U.S. Cl. ..... 219/707; 219/704; 219/719; 99/325

[58] Field of Search ..... 219/707, 702, 219/704, 703, 705, 719; 99/325

[56] References Cited

U.S. PATENT DOCUMENTS 4,350,862 9/1982 Ueda ..... 219/707
4,484,065 11/1984 Ueda ..... 219/707
4,864,088 9/1989 Hiejima et al. ..... 219/707
4,874,928 10/1989 Kasai ..... 219/707

*Primary Examiner*—Philip H. Leung

[57] ABSTRACT

An apparatus and method for detecting the presence or absence of a container cover and for determining how much food is present in a microwave oven. The apparatus includes a sensor for sensing the state of an exhaust from the heating chamber in the microwave oven, and a sensor output processor for processing a signal from the sensor, calculating cooking information according to the signal, and identifying the presence or absence of a container cover and determining how much food is present by utilizing the cooking information and inputted cooking time information to provide a control signal for controlling a heating time of said heating chamber. In particular, the apparatus includes a sensor output processing section for converting the signal from the sensor into a digital signal, a perception processing section for receiving the sensor output signal outputted from the sensor corresponding to a cooking progress, for calculating an area ratio utilizing the sensed signal, and for perceiving the presence or absence of the container cover and determining how much food is present, and a controller for controlling a driving section by calculating a heating time based on the perceived information perceived by the perception processing section.

5 Claims, 9 Drawing Sheets

APPARATUS AND METHOD FOR PERCEIVING OR ABSENCE OF A COVER FOR A CONTAINER AND FOR DETERMINING A QUALITY OF FOOD IN THE CONTAINER IN A MICROWAVE OVEN

BACKGROUND OF THE INVENTION

1. Field of the Invention

The present invention relates to an apparatus and method for detecting the presence or absence of a container cover and detecting a quantity of food in a microwave oven by utilizing an area ratio value calculated when the resistivity of sensor reaches a predetermined reference point for calculating the area ratio value.

2. Description of the Related Art

FIG. 1 illustrates a block diagram of a prior art microwave oven. The prior art microwave oven includes a turntable 3 on which container 2B for food 2A is placed, and a turntable motor 4 for rotating the turntable 3 is installed below the turntable 3.

In one side wall of heating chamber 1, there is magnetron 5, a microwave guide pipe 6 for guiding a microwave generated by the magnetron 5 into the heating chamber, a lamp 7 which is illuminated during the cooking operation, an air suction opening 8, a fan motor 9 and a fan 10 for cooling the magnetron 5, and a high voltage transformer 11 for applying high voltage to the magnetron 5. In the other side wall of the heating chamber 1, there is an exhaust opening 12 for discharging air, vapor, or gas, and a sensor 13 for sensing an output signal sensed by the sensor 13.

Outside of heating chamber 1, there are also a sensor output processing section 14 for converting a variation of resistance value, a detection processing section 15 for detecting the presence or absence of food in the oven and the quantity thereof by utilizing the signal sensed by the sensor output processing section 14, a controller 15 for controlling the heating of food 2, a key matrix 17 for inputting key signals of the cooking menu, start, or stop functions and providing the key signal to the controller 15, and a driving section 18 for selectively driving the driving motor 4, the magnetron 5, the high voltage transformer 11, the lamp 7, or the fan motor 9.

FIG. 2 is a graph of output waveforms sensed by the sensor 13 which is observed variation of the signal waveforms corresponding to the presence or absence of a container cover and the quantity of food in the container.

For example, even if food is prepared for one person, different characteristic waveforms may be observed depending on the presence or absence of the container cover because much gas or vapor is observed when a container cover is not present.

Therefore, the prior art microwave oven controls the cooking process by detecting whether a container cover is present and the quantity of food present, utilizing the signal sensed by the sensor 13, calculating suitable heating time according to the detected result to perform the heating control.

FIG. 3 is a flow chart showing the cooking control progress according to the prior art microwave oven shown in FIG. 1. Referring to FIG. 3, the flow chart illustrates an embodiment for perceiving a quantity of food for between 1 and 5 persons relative to the presence 6r absence of a container cover, respectively, with respect to FIG. 2.

First, when a user operates the key matrix 17 and selects a cooking menu by using menu keys provided in the key matrix 17 (step 301), the controller 16 senses the heating control information corresponding to the selected menu. When the user selects a start key provided in the key matrix 17 (step 302), the controller 16 drives oscillating terms of the magnetron, the fan motor 9, the fan 10, and turntable motor 4 for driving the turntable 3 microwave generated in the magnetron 5 is guided to the inside of the heating chamber 1 for heating the food 2A through the microwave guide pipe 6, air, vapor, or gas produced from the heating chamber 1 by heating the food 2 are discharged through the exhaust opening 12. At this stage, air, vapor, or gas are sensed by the sensor 13.

The output signal generated by the sensor 13 is identified by the sensor output processing section 14 and provided the identified signal as information of cooking progress section 15. The perception processing section 15 calculates and stores an initial value (resistivity Ro) of the sensor 13 (step 303) and calculates the output signal (Rs) of the sensor 13 repeatedly (step 304).

The perception processing section 15 also calculates and stores a resistivity Rs/Ro of the initial value Ro and the sensed value Rs. Vapor and gas generated in the heating chamber 1 are exhausted through the exhaust opening, so the output of the sensor 13 varies in proportion to the temperature increase of the exhausted gas and vapor (refer to FIG. 2).

When the cooking time reaches a first predetermined reference time T1, the perception processing section 15 calculates a resistivity $\Delta g1$ (sensed Rs/Ro) and stores it (step 305). The cooking time reaches a second predetermined reference time T2 during calculation the resistivity repeatedly, and the perception processing section 15 also calculates a resistivity $\Delta g2$ and stores it (step 306).

In the next stage, if the resistivity $\Delta g$ reaches a predetermined point such as $\Delta gc=1.05$, the perception processing section 15 calculates the resistivity at every 20 seconds after the point and calculates an increasing value $\Delta gINC$ and stores it (step 307).

Also, if the resistivity reaches a predetermined sensing point such as $\Delta g=1.3$, the perception processing section 15 determine a sensing time and stores it (step 308).

In next stage, the perception processing section 15 identifies that the cooking time has reached the second reference time T2 and the resistivity $\Delta G$ passes the sensing point simultaneously (step 309).

If the cooking time does not reach the second reference time T2 or the resistivity $\Delta G$ does not pass the sensing point, the process is looped back to step 304 (step 309).

However, if the cooking time second reference time T2 and the resistivity $\Delta G$ passed, a next step (step 310) to identify the presence or absence of the container cover, as well as the quantity of food present, is performed.

First, the resistivity $\Delta g1$ stored in step 305 is compared with a predetermined reference resistivity $\Delta g1$ (Ref) and the resistivity $\Delta g2$ stored in the step 306 is compared with a predetermined reference resistivity $\Delta g2$ (Ref). At this stage, if the comparison results do not satisfy the conditions $\Delta g1<\Delta g1$ (Ref) or $\Delta g2<\Delta g2$ (Ref), the controller 16 decides between a quantity of food for one person or two persons without the container cover (step 311). Thus, it compares the sensing time Ts stored in step 308 with a predetermined reference time NC1 (Ref) for one person without the container cover, and a predetermined reference time NC2 (Ref) for two persons without the container cover, respectively.

If the comparison result is Ts<NC1 (Ref) and Ts<NC2 (Ref) , the controller 16 identifies that food for one person without a container cover is present (step 312).

However, if the comparison result does not satisfy Ts<NC1 (Ref) and Ts<NC2 (Ref), the controller 16 identifies that food for two persons without a container cover is present (step 313).

On the other hand, if the comparison results in step 310 is Δg1<Δg1 (Ref) or Δg2<Δg2 (Ref), step 314 is performed (see FIG. 3B) . In step 314, the stored resistivity Δg2 is compared with the reference resistivity Δg2 (Ref). If the comparison result is Δg2<Δg2 (Ref) , step 315 is performed to compare the sensing time Ts stored in step 308 with a predetermined reference time C3 (Ref) for 3 persons with a container cover present, and a predetermined reference time C4 (Ref) for 4 persons with a container cover present, respectively.

If the comparison resultin step 315 is Ts<C3 (Ref) and Ts<C4 (Ref), the controller 16 identifies that food for 3 persons with a container cover is present (step 316). However, if the comparison result is not Ts<C3 (Ref) and Ts<C4 (Ref), step 317 is performed to compare the sensing time Ts with a predetermined reference time C4 (Ref) for 4 persons with a container cover, and with a predetermined reference time C5 (Ref) for 5 persons with a container cover, respectively.

If the comparison result in the step 317 satisfies Ts<C4 (Ref) and Ts<C5 (Ref), the controller 16 identifies that food for 4 persons with a container cover is present. If the foregoing condition is not satisfied, the controller 16 identifies that food for 5 persons with a container cover is present.

On the other hand, if the condition Δg2<Δg2 (Ref) is not satisfied in the step 314, step 320 will be performed to compare the increased value ΔgINC of the resistivity stored in the step 307 with a predetermined reference value Δg1NC (Ref).

If the comparison result in the step 320 satisfies ΔgINC>ΔgINC (Ref), step 321 is performed to compare the sensing time Ts with the reference time C1 (Ref) for one person and the reference time C2 (Ref) for one person and the reference time C2 (Ref) for two persons in case that the container cover is present.

If the comparison result satisfies Ts<C1 (Ref) and Ts<C2 (Ref), step 322 is performed to determine if food for one person with a container cover is present, otherwise step 323 is performed to determine if food for two persons with a container cover is present.

On the other hand, the comparison result in the step 320 does not satisfy Δg1NC>Δg1NC (Ref), step 324 is performed to compare the sensing time Ts with a predetermined reference time NC3 (Ref) for 3 persons and a predetermined reference time NC4 (Ref) for 4 persons in a case where a container cover is not present.

If the comparison result in the step 324 satisfies Ts<NC3 (Ref) and Ts<NC4 (Ref), step 325 is performed to identify that food for 3 persons without a cover is present. Otherwise, step 326 is performed to compare the sensing time Ts with predetermined reference times NC4 (Ref) for 4 persons and NC5 (Ref) for 5 persons, respectively, for a case that a container cover is not present.

If the comparison result in the step 326 satisfies Ts<NC4 (Ref) and Ts<NC5 (Ref) step 327 is performed to identify that food for 4 persons is present. Otherwise, step 328 is performed to identify that food for 5 persons without a container cover is present.

In the next stage after determining the presence or absence of a container cover and determining the quantity of food present, the controller 16 calculates a heating constant value K corresponding to the determined quantity of food and whether a container cover is present, respectively. The controller 16 calculates a total heating time T total according to the following equation.

$$T\ \text{total}=(1+K)\times Ts$$

The controller 16 drives the magnetron 5 and the turntable 4 and checks whether the cooking time reaches the calculated total heating time T total (step 331).

At this stage, if the total heating time is not reached, the controller 16 causes the driving section 18 to either heat continuously (step 332) or to stop.

According to the prior art for detecting the presence of a container cover and detecting the quantity of food present in the microwave oven, the waveform of a sensed signal tends to shift easily, causing voltage variations because detecting the presence of a container cover and the quantity of food present is determined by the relation of the predetermined sensing point and the resistivity.

Therefore, since the reference sensing points are caused by generating of such shifted waveform, determining whether a container cover is present and determining the amount of food present can be inexact.

This problem affects the overall cooking progress, including controlling total heating time based on the detected results, and results in poor cooking quality.

SUMMARY OF THE INVENTION

An object of the present invention is to provide an apparatus and method for detecting whether a cover for a container of food is being use, and determining the quantity of food in the container in a microwave oven based on a voltage variation by using an area ratio value which is obtained by an integrated area over a total area.

In view of such goals, the present invention provides to an apparatus for detecting the presence of a container cover and for determining a quantity of food present in a microwave oven having a sensor for sensing the states of air, vapor, or gas discharged from a heating chamber provided in the microwave oven, and a sensor output processor for identifying a signal sensed by the sensor, determining cooking information according to the sensed signal, and determining whether a container cover is present and determining the quantity of food, using the cooking information and predetermined cooking time information to provide a control signal for controlling a heating time of said heating chamber. The apparatus according to the present invention comprises:

- a convertor for converting the sensed signal outputted from the sensor into an area ratio value of the cooking time over resistivity sensed by the sensor;
- a first comparator for comparing the area ratio value converted by the convertor with a reference area ratio;
- a second comparator for comparing sensing times and quantity identification points with respective reference values, for existence and nonexistence states of said container cover, respectively, according to comparison results of the first comparator; and
- a detector for determining whether or not container cover is being used and the quantity of food present according to comparison results of the second comparator.

Moreover, the present invention provides a method of detecting the presence or absence of a container cover and a quantity of food in a microwave oven. The microwave oven has a sensor for sensing the states of air, vapor, or gas discharged from a heating chamber provided in the microwave oven, and a sensor output processor for identifying a signal generated by the sensor, determining cooking information according to the sensed signal, and detecting the presence or absence of the container cover and said quantity of food using the cooking information and predetermined cooking time information to provide a control signal for controlling a heating time of said heating chamber. The method according to the present invention comprises the steps of:

(a) calculating and storing an initial resistivity value of the sensor and resistivity values sensed by the sensor after a predetermined time;

(b) determining a sensing time when a resistivity value calculated using the sensed resistivity value reaches a predetermined sensing point;

(c) calculating an area ratio value of a predetermined cooking time over the resistivity value when the resistivity value reaches a predetermined reference point for calculating an area ratio value, wherein the resistivity value is determined by the ratio of cooking time over resistivity; and (d) determining whether the container cover is present and the quantity of food present utilizing the area ratio value and the sensing time.

BRIEF DESCRIPTION OF THE DRAWINGS

The above objects, as well as other features of the present invention will become more apparent by describing the preferred embodiments thereof with reference to the accompanying drawings, in which.

DETAILED DESCRIPTION OF THE PREFERRED EMBODIMENTS

Figure 1:
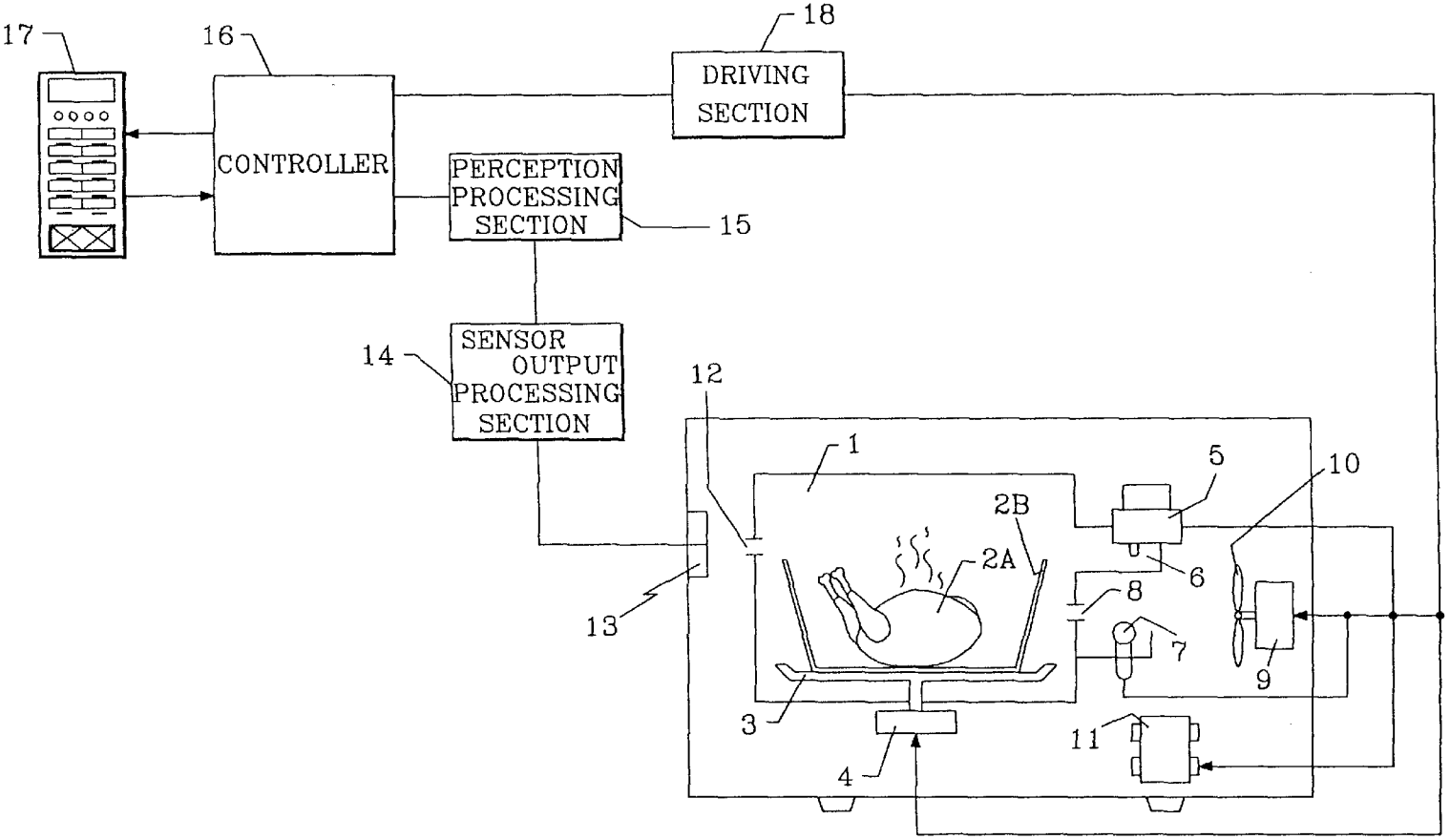
FIG. 1 (PRIOR ART)
FIG. 1 is a block diagram of a prior art microwave oven.
Figure 2:
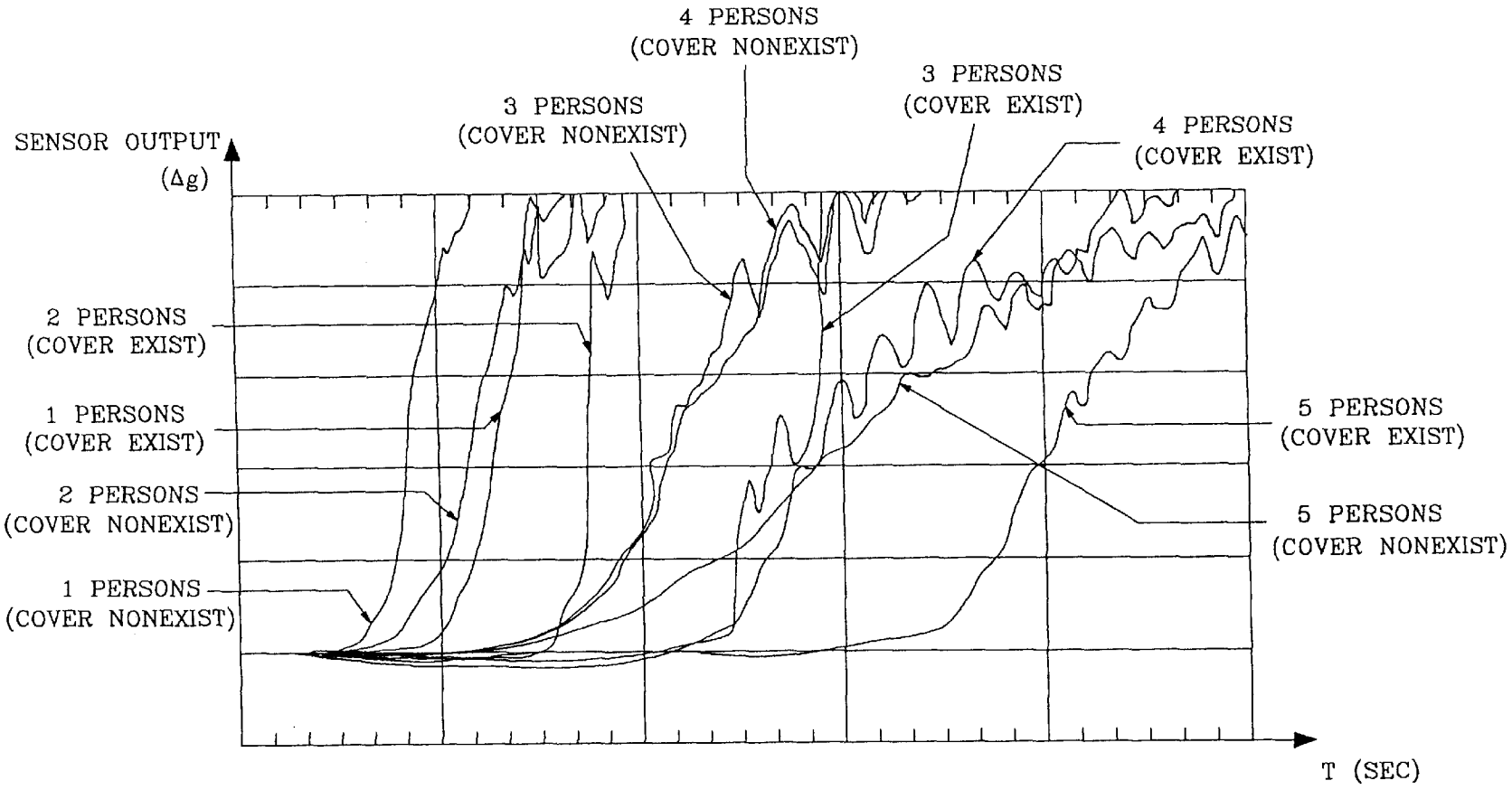
FIG. 2 (PRIOR ART)
FIG. 2 is a graph of output waveform corresponding to the presence or absence of a container cover and a quantity of food according to the prior art microwave oven.
Figure 3A:
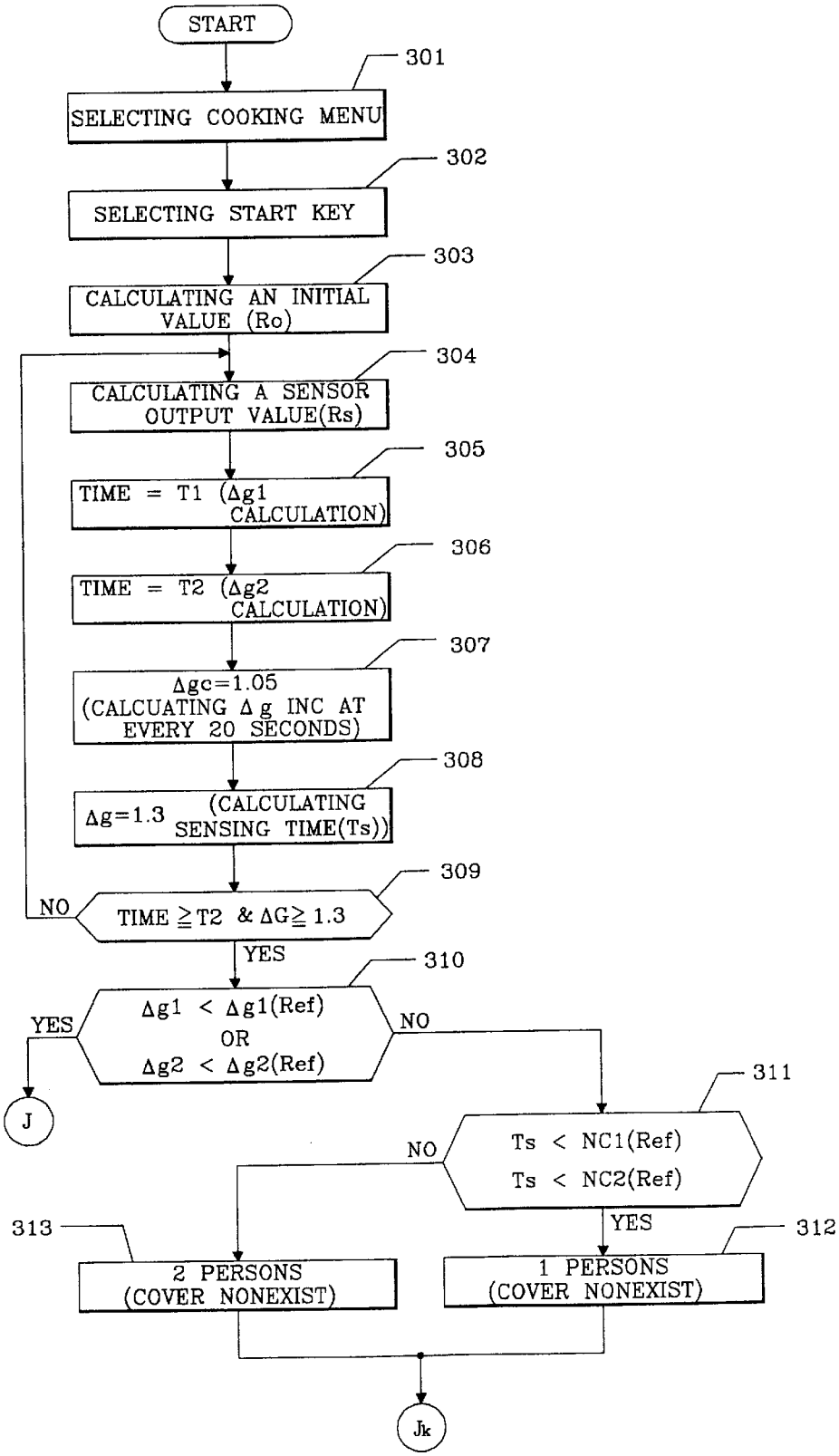
FIG. 3A(PRIOR ART)
FIG. 3 is a flow chart showing the operation of cooking control progress according to the prior art microwave oven.
Figure 3B:
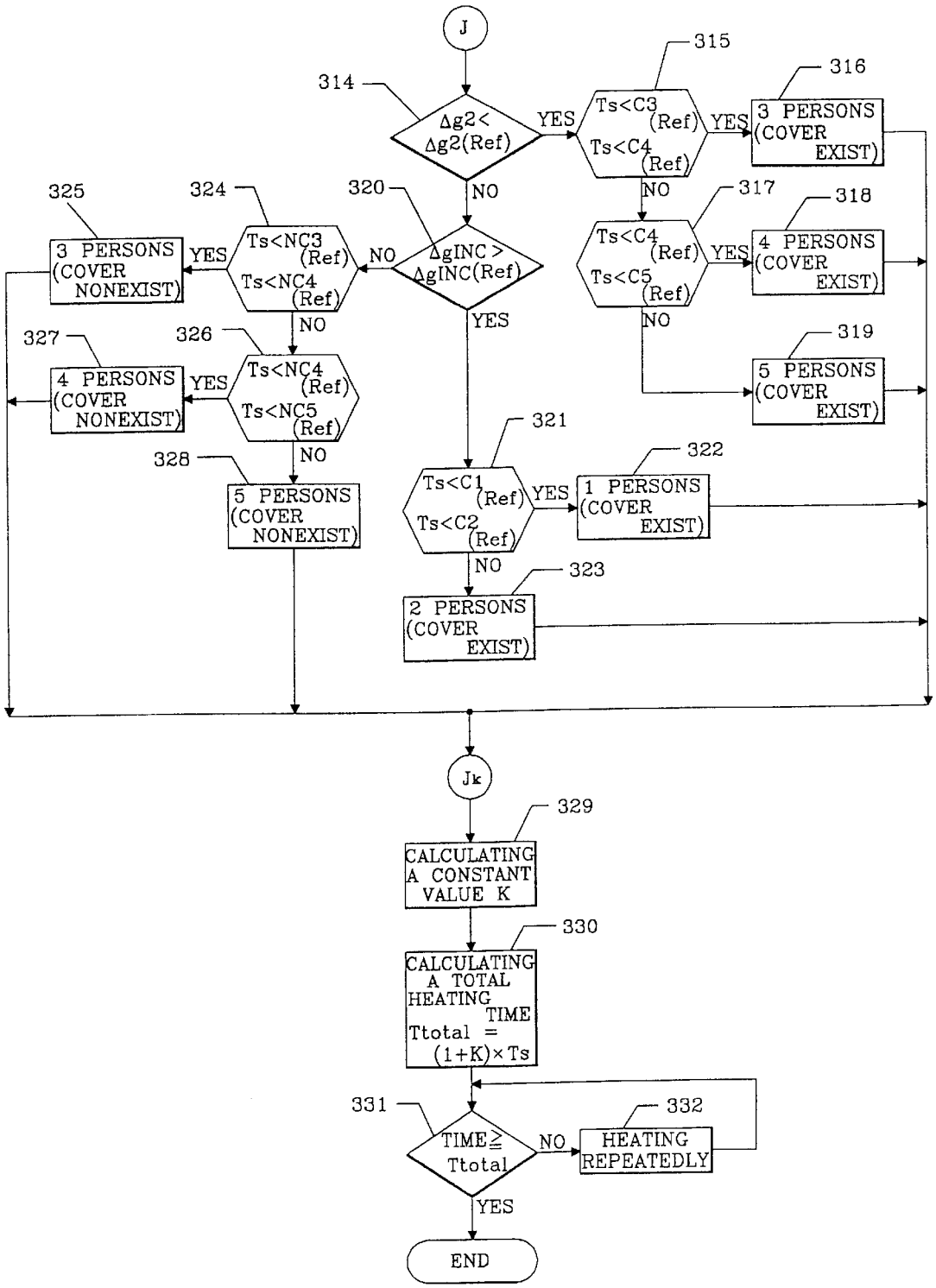
FIG. 3B (PRIOR ART)
Figure 4:
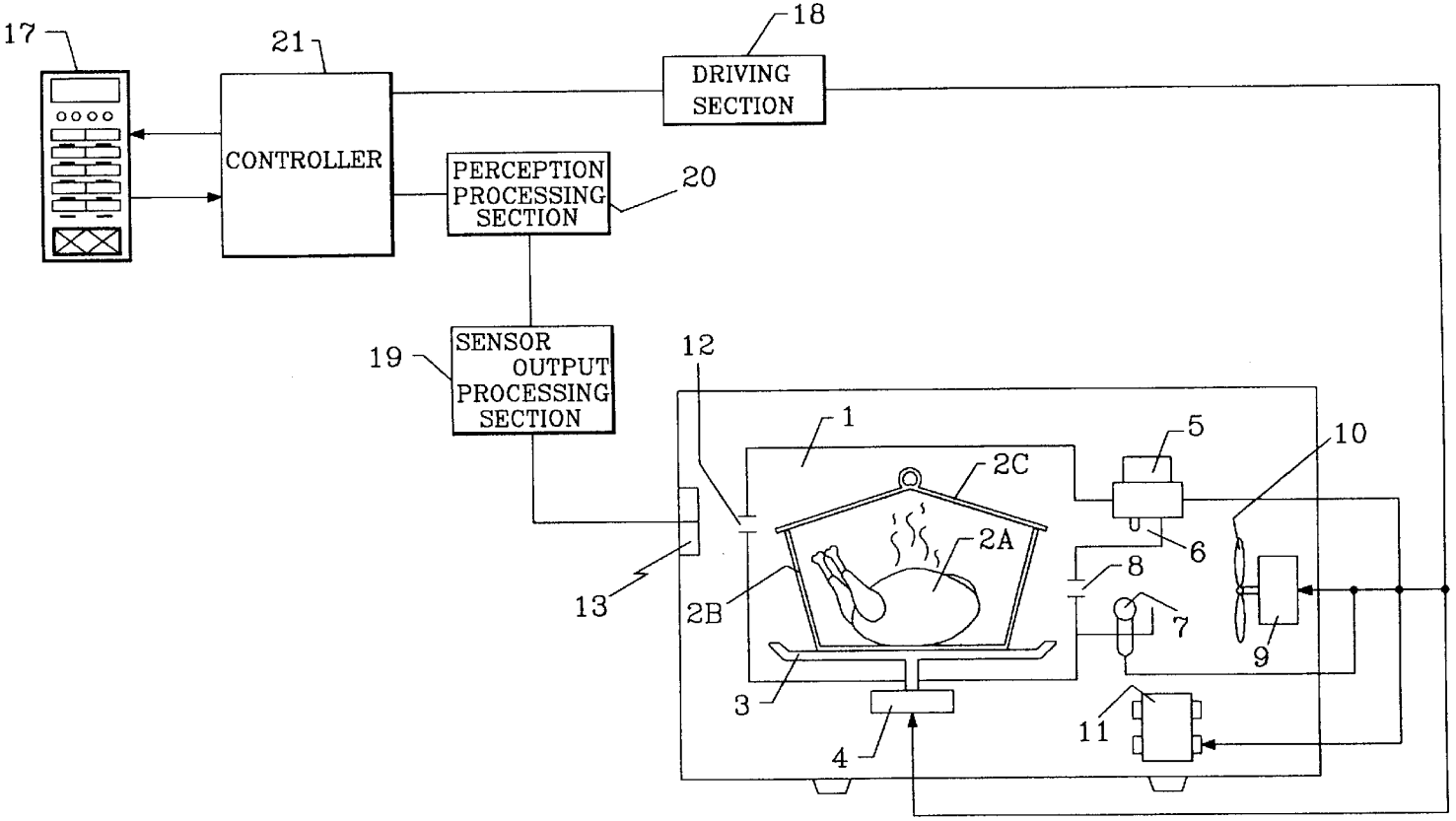
FIG. 4 is a block diagram according to the present invention.

FIG. 4 is a block diagram illustrating a microwave oven according to the present invention. The same elements used in the prior art microwave oven shown in FIG. 1 are given to same reference numbers, and the explanation for same construction will be omitted hereinafter.

Figure 5:
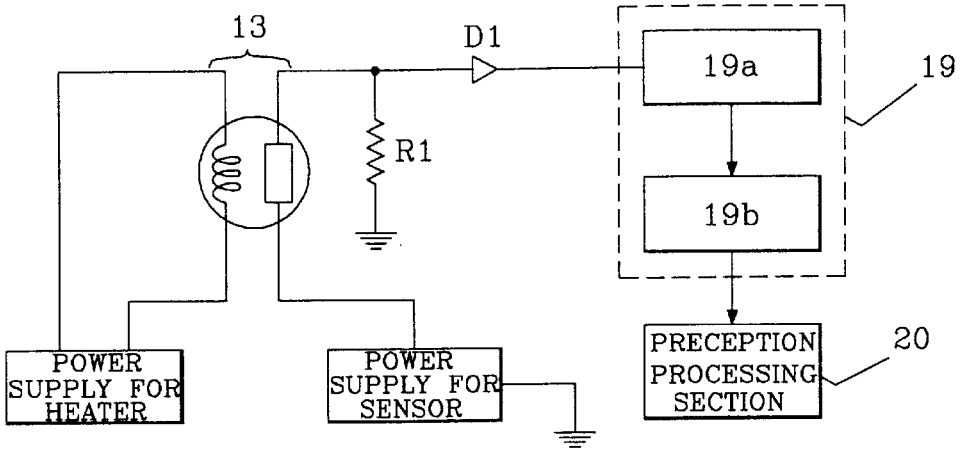
FIG. 5 is a circuit diagram illustrating detailed construction of a sensor output processing section.

Referring to FIG. 4, the apparatus according to the present invention comprises a sensor output processing section 19 for converting a sensed signal from a sensor 13 for air, vapor, or gas into digital signal, a perception processing section 20 for perceiving the sensor output signal outputted from the sensor 13 corresponding to cooking progress, calculating an area ratio value utilizing the sensed signal, and perceiving the presence or absence of the container cover and determining the quantity of food, and a controller 21 for controlling a driving section 18 by calculating a heating time corresponding to the perceived information provided by the perception processing section 20. FIG. 5 is a circuit diagram illustrating detailed construction of the sensor output processing section 19. Referring to FIG. 5, the sensor output processing section 19 has a multiplexer 19*a* for selecting the type of output signal outputted from the sensor 13, receiving electric power from power supplies for the heater and sensor, and an analog/digital converter 19*b* for converting the output signal of the multiplexer 19*a* into a digital signal and providing the digital signal to the perception processing section 20.

Figure 6:
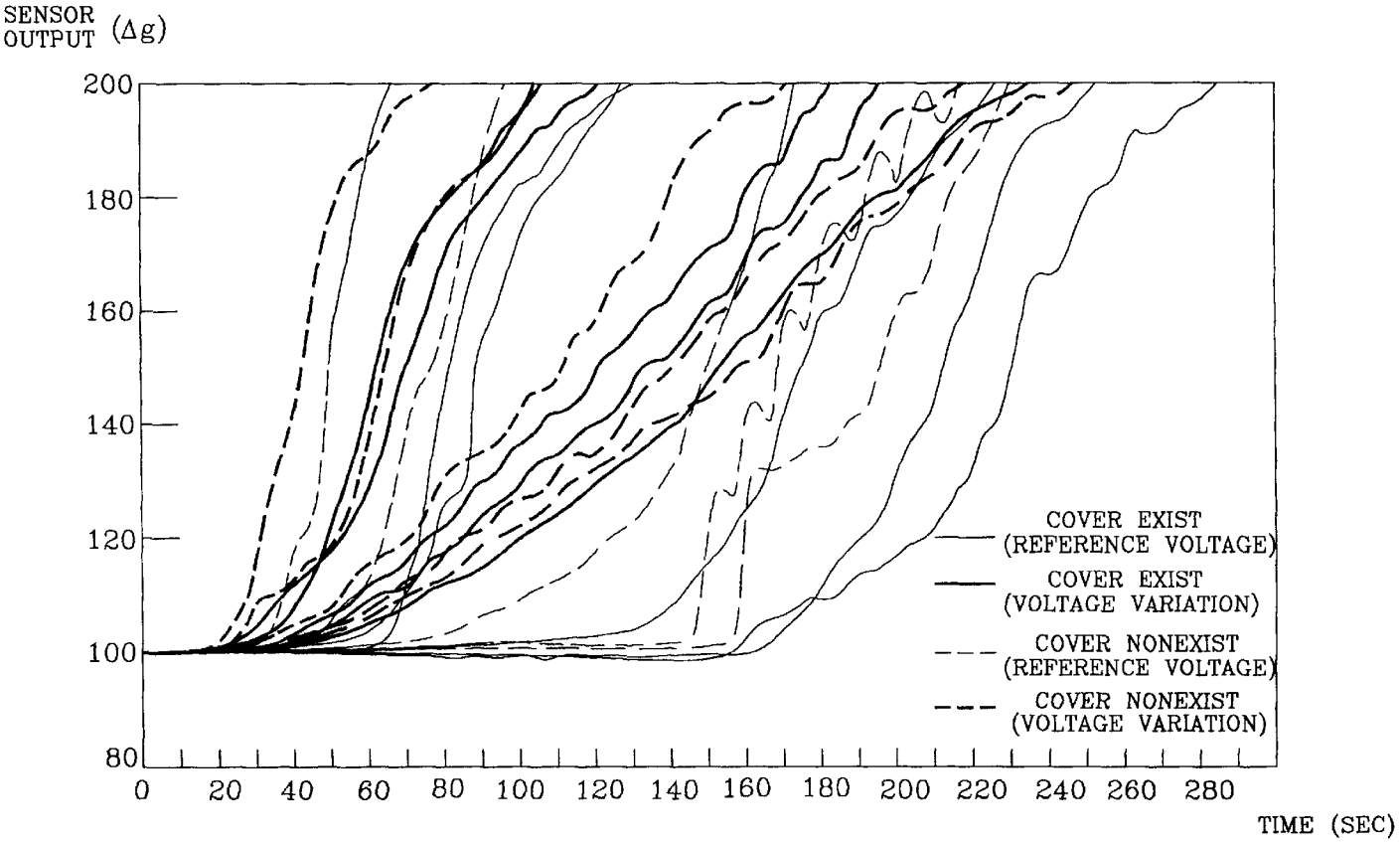
FIG. 6 is a graph of output waveforms according to the present invention.

FIG. 6 is a graph of output waveforms according to the present invention which is observed sensed waveforms in case that waveform shift is happened according to sensed waveform to a reference voltage and voltage variation when the container cover is existent and nonexistent.

Figure 7:
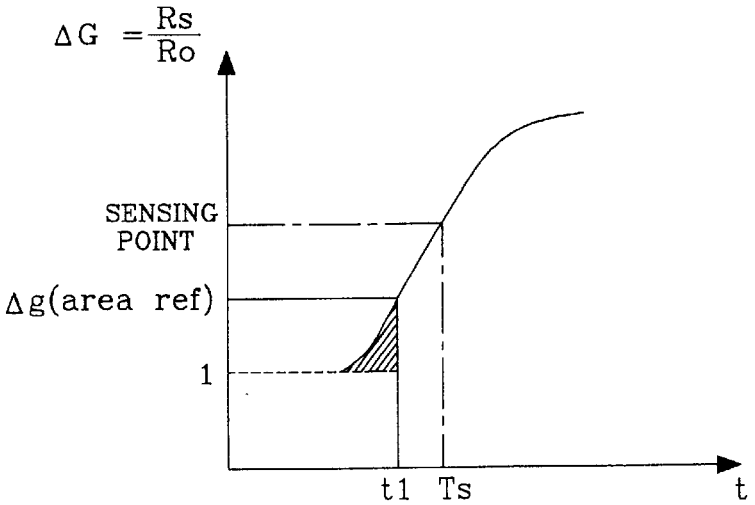
FIG. 7 is a graph of an area ratio value according to the present invention.

As observed in FIG. 6, the sensed waveforms vary according to the voltage variation. Thus, this variation causes an error for determining the presence or absence of the container cover and the quantity of food when the sensed signal is used directly. Therefore, the present invention determines the presence or absence of the container cover and the quantity of food by utilizing the area ratio as a constant which is not affected by the voltage variations over time. FIG. 7 illustrates an area ratio of the sensor 13 according to the present invention. Here, the area ratio is obtained by calculating $\Delta g \times t1$, wherein $\Delta g$ is a predetermined reference resistivity and T1 is a time at which the sensor output reaches the reference resistivity $\Delta g$. The value of the sensor output is integrated over the time t until the sensor output reaches the reference resistivity and then an integrated value is divided by the reference resistivity.

Figure 8A:
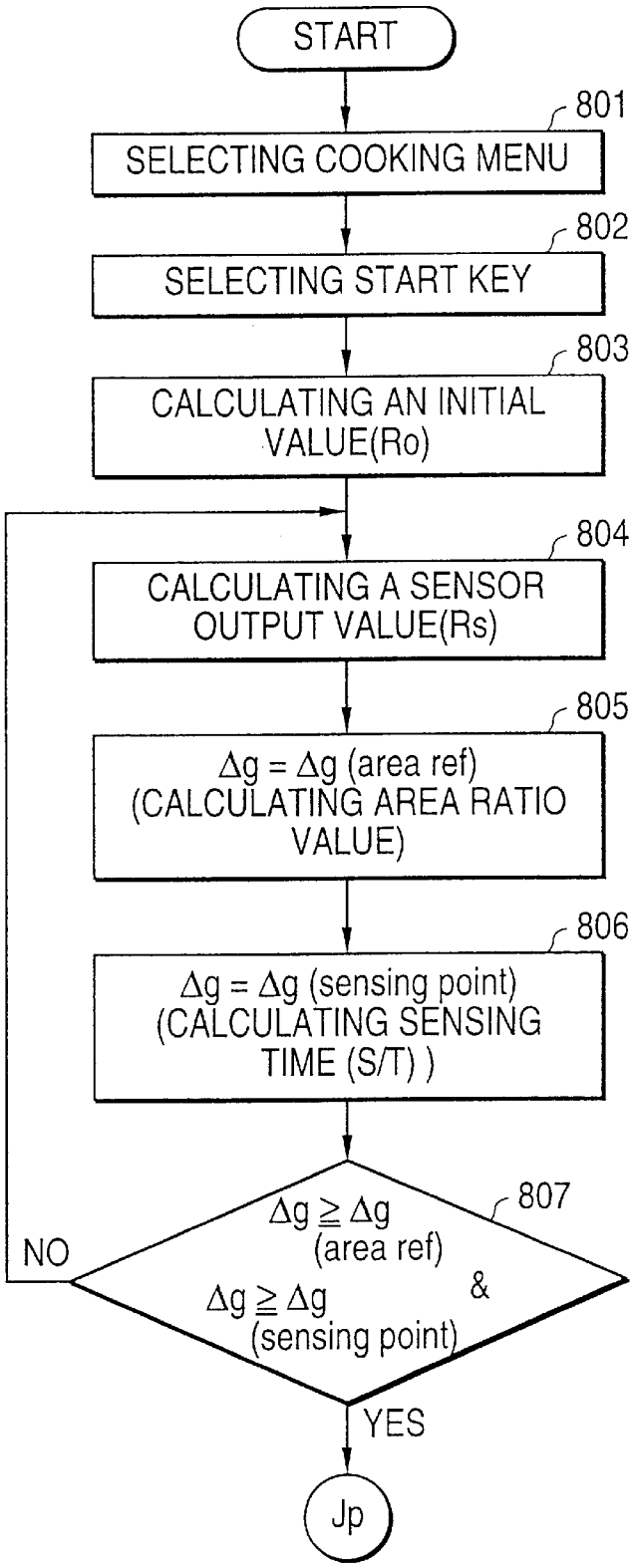
FIG. 8 is a flowchart showing the operation of cooking control progress according to the present invention.
Figure 8B:
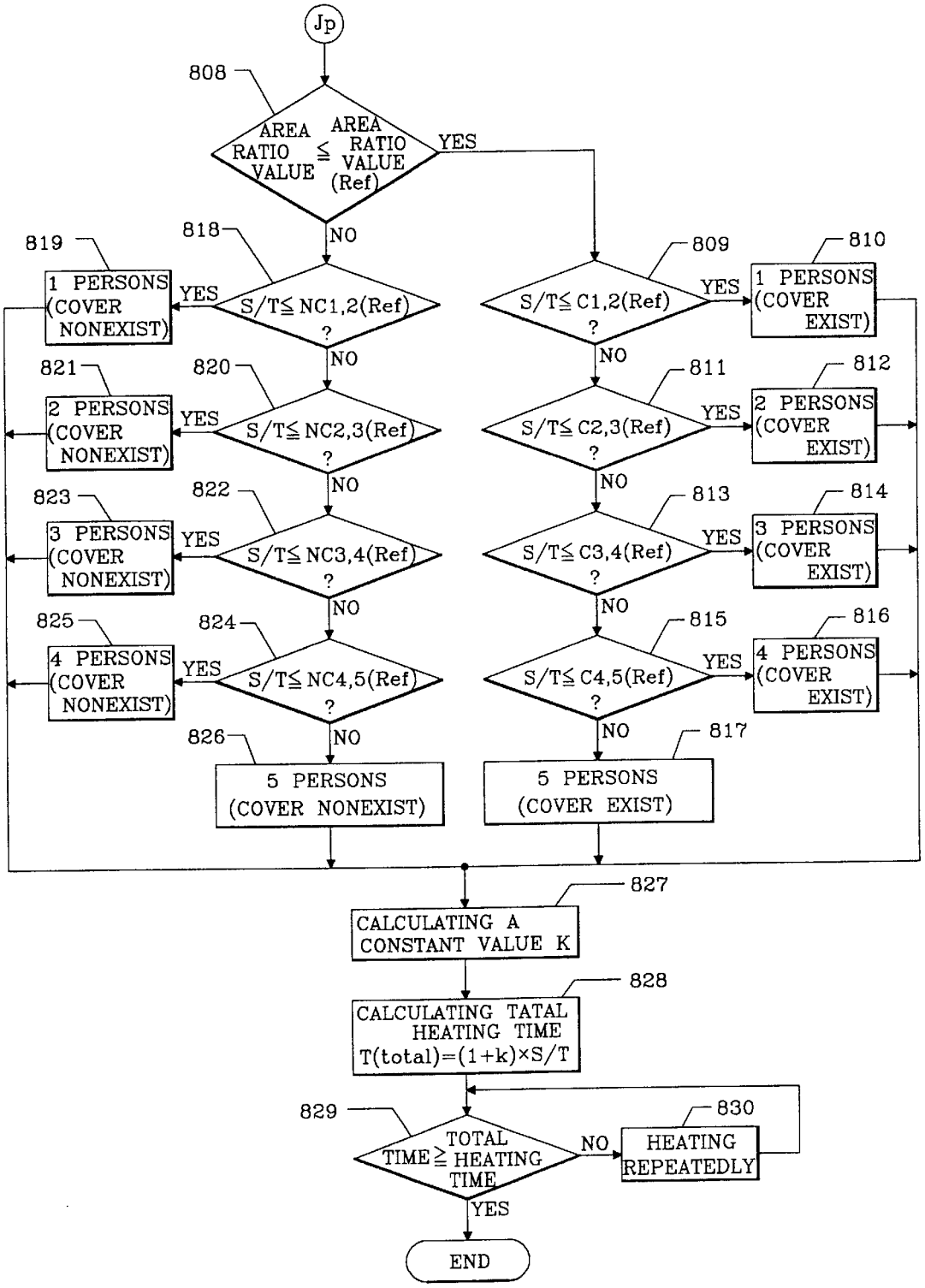

Thus, the area ratio is the area of deviant section. The operation of detecting the food container cover and determining the quantity of food in the microwave oven according to the present invention will be described with respect to attached FIG. 8.

First, when a user operates the key matrix 17 and selects a cooking menu by using menu keys provided in the key matrix 17 (step 801). When the user selects a start key (step 802), controller 21 perceives the output signal corresponding to the start key and controls a driving section 18. Thus, the process of cooking food 2A is performed by rotating turntable 3 as a result of oscillation of a magnetron 5, driving fan 9 with fan motor 10, and turntable motor 4.

Air, vapor, or gas produced from the heating chamber 1 corresponding to heating food 2A is discharged through exhaust opening 12 by the fan 10. At this stage, a sensor 13 senses the exhaust. The corresponding output signal of the sensor 13 is provided to a perception processing section 20 after converting the output signal into a digital signal utilizing the multiplexer 19*a* and the analog/digital converter 19*b*. The perception processing section 20 calculates an initial resistivity value Ro of the sensor 13 after a predetermined time period elapses (step 803) and calculates the output resistivity value Rs of the sensor 13 continuously (step 804).

The perception processing section 20 also stores the calculated values. The output resistivity value of the sensor 13 varies like the waveform shown in FIG. 6, in proportion to vapor, gas, or temperature increase which are discharged by heating food 2A continuously. Thus, the output value (resistivity: Rs/Ro) sensed by the sensor 13 varies accordingly.

The perception processing section 20 stores the initial resistivity Ro and calculates the resistivity repeatedly, and calculates the area ratio when the resistivity reaches a predetermined reference resistivity, as shown in FIG. 7.

The area ratio value is calculated in such manner that a total area is obtained by calculating Δg×t1, wherein Δg is a predetermined reference resistivity and t1 is a time which the sensor output reaches the reference resistivity. The value of the sensor output is then integrated over the time until the sensor output reaches the reference resistivity. The integrated value is then divided by the reference resistivity.

Thus, the area ratio value represents the deviant section t1×Δg (area Ref) in FIG.7. The perception processing section 20 also calculates a sensing time S/T and stores it when the resistivity Δg reaches a predetermined sensing point (such when as Δg=1.3) during cooking (step 806), and simultaneously identifies when the sensed resistivity Δg reaches a reference point for calculating the area ratio value Δg (area Ref) and when the resistivity Δg reaches the sensing point.

If the sensed resistivity Δg reaches the reference point Δg (area Ref) calculating the area ratio value and the resistivity Δg does not reach simultaneously, it is performed from step 804.

However, if the resistivity Δg reaches the reference Δg (area Ref) and the sensing point simultaneously, step 808 is performed to detect the presence or absence of the container cover and to determine the quantity of food that is present.

First, the process compares the area ratio value calculated and stored in step 805 with the reference area ratio value (Ref) in step 808.

If the comparison result satisfies the condition that area ratio value 5 reference area ratio value, step 809 is performed; otherwise, step 818 is performed.

In the next stage, it compares the sensing time S/T calculated and stored in step 806 with a predetermined reference values C1,2 (Ref), or one and two persons, respectively, in case that the container cover is present, in step (809).

In step (811), it compares the sensing time S/T calculated and stored in step (806) with a predetermined reference values C2,3 (Ref) for 2 and 3 persons, respectively, in case that the container cover is present. If the comparison result in step (811) satisfies the condition S/T≦C2,3 (Ref), step 812 is performed to identify that the quantity of food is for 2 persons with the container cover. Otherwise, if it satisfies the condition S/T>C2,3 (Ref), then step (813) is performed.

In step (813), the sensing time S/T calculated and stored in step (806) is compared with predetermined reference values C3,4 (Ref) for 3 and 4 persons, respectively, when that the container cover is existent.

If the comparison result in step (813) satisfies the condition S/T≦C3,4 (Ref), step (814) is performed to identify that the quantity of food is for 3 persons with the container cover. Otherwise, if S/T>C3,4 (Ref), step (815) is performed.

In step (815), it compares the sensing time S/T calculated and stored in step (806) with predetermined reference values C4,5 (Ref) for 4 and 5 persons, respectively, in case that the container cover is present.

If the comparison result in step (815) satisfies the condition S/T≦C4,5 (Ref), step (816) is performed to identify that the quantity of food is for 4 persons with the container cover. Otherwise, if S/T>C4,5 (Ref), step (827) is performed.

On the other hand, if the comparison result in step (808) satisfies the condition that area ratio value> area ratio value (Ref), step (818) is performed to determine the quantity of food in cases where a container cover is not present.

In step (818), the sensing time S/T calculated and stored in step (806) is compared with predetermined reference values NC1,2 (Ref) for 1 and 2 persons, respectively, in case that the container cover is not present.

If the comparison result in step (818) satisfies the condition S/T≦NC1,2 (Ref), step (827) is performed to identify that the quantity of food is for 1 person without the container cover. Otherwise, if S/T>NC1,2 (Ref), step (820) is performed.

In step (820), the sensing time S/T calculated and stored in step (806) is compared with predetermined reference values NC2,3 (Ref) for 2 and 3 persons, respectively, in case that the container cover is not present.

If the comparison result in step (820) satisfies the condition S/T≦NC2,3 (Ref), step (821) is performed to identify that the quantity of food is for 2 persons without the container cover. Otherwise, if S/T>NC2,3 (Ref), step (822) is performed.

In step (822), the sensing time S/T calculated and stored in step (806) is compared with predetermined reference values NC3,4 (Ref) for 3 and 4 persons, respectively, in case that the container cover is not present.

If the comparison result in step (822) satisfies the condition S/T≦NC3,4 (Ref), step (823) is performed to identify that the quantity of food is for 3 persons without the container cover. Otherwise, if S/T>NC3,4 (Ref), step (824) is performed.

In step (824), the sensing time S/T calculated and stored in step (806) is compared with predetermined reference values NC4,5 (Ref) for 4 and 5 persons, respectively, in case that the container cover is not present.

If the comparison result in step (824) satisfies the condition S/T≦NC4,5 (Ref), step (825) is performed to identify that the quantity of food is for 4 persons without the container cover. Otherwise, if S/T>NC3,4 (Ref), step (826) is performed to identify that the quantity of food is for 5 persons without the container cover.

In the next stage, after determining the presence or absence of the container cover and the quantity of food, the controller 21 calculates a heating constant value K (Step 827), and calculates a total heating time T(total) according to the following equation (step 828):

$$T(\text{total})=(1+K)\times S/T$$

In the next stage, if the cooking time does not equal the calculated total heating time (step 829), the heating operation is continued (step 830). However, if the cooking time reaches the calculated total heating time, the controller 21 stops the driving section 18 to stop the cooking process.

According to the present invention as described hereinabove, the presence or absence of a container cover can be accurately determined, utilizing the area ratio value which is not affected by voltage variations in the cooking process. Therefore, a user can make good food because the quantity of food is accurately determined, so food quantity and taste are improved by obtaining the best heating time for the cooking process.

While the present invention has been described and illustrated herein with reference to the preferred embodiments thereof, it will be understood by those skilled in the art that various changes in form and details may be made therein without departing from the spirit and scope of the invention.

What is claimed is:

1. In a microwave oven having a cooking space, an apparatus for detecting a cover for a container of food in the cooking space and for determining the amount of food in the container, whereby operation of the microwave oven is controlled, the apparatus comprising:

a sensor constructed and arranged to sense a characteristic of an exhaust emitted from the cooking space during a cooking operation, a resistance of said sensor varying in accordance with said sensed characteristic;

a perception processing section comprising:

means for determining and storing an initial resistance of said sensor;

means for determining an instantaneous resistance of said sensor during said cooking operation;

means for determining a resistivity of said sensor, said resistivity being said instantaneous resistance of said sensor divided by said initial resistance of said sensor, said resistivity varying as a function of time;

means for determining an area ratio by integrating said resistivity over time, until a time at which said resistivity reaches a first threshold resistivity, and dividing said integrated value by said first threshold resistivity;

means for identifying a sensing time at which said resistivity reaches a second threshold resistivity;

means for determining, at an instantaneous time, whether said resistivity is greater than said first and second threshold resistivities;

means for comparing, if said resistivity is greater than said first and second threshold resistivities simultaneously, said area ratio with a reference area ratio, wherein, when said area ratio is less than or equal to said reference area ratio, a determination is made that the container of food lacks a cover, and when said area ratio is greater than said reference area ratio, a determination is made that the container of food includes a cover;

means for comparing said sensing time with one of a first and second plurality of reference times, said first and second pluralities of reference times corresponding to said determination of whether or not the container of food includes a cover, respectively, wherein each comparison of said sensing time with a said reference time corresponds to a determination of an amount of food present in the food container; and a controller constructed and arranged to calculate a heating constant in accordance with said determination of the amount of food in the food container and whether or not the food container includes a cover, and provide a control signal for setting a cooking time period corresponding to said calculated heating constant, during which the microwave oven is operated.

2. The apparatus as claimed in claim 1, further comprising a sensor output processing section constructed and arranged to receive an input from said sensor, convert said input into a digital signal, and pass said digital signal to said perception processing section.

3. The apparatus as claimed in claim 2, wherein said sensor output processing section comprises a multiplexer and an analog/digital signal converter.

4. A method of controlling the operation of a microwave oven in which a container of food is being heated, comprising the steps of:

determining and storing an initial resistance of a sensor;

with the sensor, detecting a characteristic of an exhaust emitted by the microwave oven during a cooking operation;

continuously determining and storing an instantaneous resistance of the sensor during the cooking operation, the resistance of the sensor varying over time according to the characteristic of the exhaust being sensed thereby;

determining a resistivity of the sensor by dividing the instantaneous resistance of the sensor by the initial resistance of the sensor;

integrating the resistivity over time, until a time at which the resistivity reaches a first threshold resistivity, and dividing the integrated result by the first threshold resistivity, thereby obtaining an area ratio;

identifying a sensing time at which the resistivity reaches a second threshold resistivity;

determining whether the resistivity is greater than or equal to the first threshold resistivity and the second threshold resistivity;

comparing, when the resistivity is greater than or equal to the first threshold resistivity and the second threshold resistivity, the area ratio with a reference area ratio, wherein, when the area ratio is less than or equal to the reference area ratio, a determination is made that the container of food lacks a cover, and wherein, when said area ratio is greater than the reference area ratio, a determination is made that the container of food includes a cover;

comparing the sensing time with first and second pluralities of reference times corresponding to the determination that the container of food includes, or does not include, a cover, respectively, wherein each reference time of said first and second plurality of reference times corresponds with a determination of an amount of food in the container of food;

determining a heating constant based on the determination of whether the container of food includes a cover and of the amount of food in the container of food;

calculating a length of time during which the microwave oven is operated, based on the calculated heating constant.

5. The method as claimed in claim 4, further comprising a step of converting a signal from the sensor into a digital signal.

* * * * *